US005397232A

United States Patent [19]

Nishimura

[11] Patent Number: 5,397,232

[45] Date of Patent: Mar. 14, 1995

[54] METAL-BRAZING PULSE BURNER

[76] Inventor: Makoto Nishimura, No. 1-28-5, Toyotama-naka, Nerima-ku, Tokyo, Japan

[21] Appl. No.: 149,112

[22] Filed: Nov. 9, 1993

[30] Foreign Application Priority Data

Nov. 10, 1992 [JP] Japan ..... 4-323748

[51] Int. Cl.[6] ..... F23C 11/04

[52] U.S. Cl. ..... 431/1; 431/349

[58] Field of Search ..... 431/1, 349

[56] References Cited

U.S. PATENT DOCUMENTS 2,043,982 6/1936 Bruneau ..... 431/349
4,834,644 5/1989 Snow ..... 431/1
5,302,111 4/1994 Jouvaud ..... 431/1

*Primary Examiner*—Carroll B. Dority
*Attorney, Agent, or Firm*—Browdy and Neimark

[57] ABSTRACT

In a metal-brazing pulse burner, a gas/air mixing pipe being comprised of a pipe member having a diameter larger than those of a combustion air supply pipe and a mixed gas supply pipe, and an air injection nozzle connected to the combustion air supply pipe to project therefrom along a central line of the pipe member, the nozzle having an injection opening at its tip end which opening is located nearby an opening of the combustion gas supply pipe opened at a sidewall of the pipe member, thereby a gas in the combustion gas supply pipe is drawn and supplied by air flow injected from the air injection nozzle. With this arrangement, a pilot flame is not blown off and quenched, and a stable pulse combustion can always be conducted.

2 Claims, 2 Drawing Sheets

METAL-BRAZING PULSE BURNER

BACKGROUND OF THE INVENTION

1. Field of the Invention

The present invention relates to a metal-brazing pulse burner used for brazing aluminum, copper or the like, and particularly, to an improvement of a metal-brazing pulse burner which reliably repeats an ignition and quenching in correspondence with a pulse control without quenching a flame of the burner which is intermittently ignited for controlling a temperature.

2. Description of the Prior Art

The present inventor has proposed to use a pulse burner for heating a work used for brazing a metal, especially an aluminum.

Such a pulse burner includes an air pump 50 for supplying a pressurized air to an air supply pipe 51, and a pressurized gas bomb 60 for supplying a pressurized gas to a gas supply pipe 52. Both the air supply pipe 51 and gas supply pipe 52 are provided with solenoid on-off valves 55, 56, respectively, which are opened and closed by control circuits having timers. In this pulse burner, the ignition and quenching are repeated at a burner head 59 to conduct a so-called pulse combustion, by intermittently supplying the air and gas at a cycle of 1 to 2 seconds.

The air and gas are continuously supplied and burned to heat a work. When a temperature rises and reaches a certain level, such increase in temperature can be suppressed by switching into the pulse combustion. At that time, it is possible to maintain the temperature of the work at a constant level by appropriately selecting a rate of on and off of the solenoid valve. However, after the solenoid valve is turned off, even if the valve is turned on, it is not ignited again if there is no pilot flame. For this reason, connected to a combustion gas supply pipe 63 is a pilot mixed gas supply pipe 64 to which a pilot gas supply pipe 53 having a flow rate control valve 57 and a pilot air supply pipe 54 having a flow rate control valve 58 are connected. With this arrangement, a pilot mixed gas is supplied to enable a continuous combustion of the pilot flame at the burner head 59 even if the solenoid valves for combustion air and gas are turned off, by always supplying a small amount of gas and air continuously to the mixed gas supply pipe 63 through the pilot mixed gas supply pipe 64.

However, this prior art pulse burner has a following problem. That is, the pilot mixed gas supply pipe 64 is opened at an intermediate portion of the mixed gas supply pipe 63 downstream from a connecting portion 61 between the combustion air supply pipe 51 and the gas supply pipe 52. Just after the solenoid valves 55 and 56 are turned on, air and gas are not mixed sufficiently, and only the air having a higher flow rate than that of the gas may flow first. Therefore, when a pilot flame is burning during off state of the solenoid valves, if these valves are turned on, only the air having higher flow rate may flow, and this air flow may blow off the pilot flame and the burner is quenched, which makes it difficult to stably conduct a pulse combustion.

More specifically, in the prior art burner, since a flow speed of air at the moment when the solenoid valves are turned on becomes faster than the combustion speed of gas, only the air flows and the gas combustion can not catch up with the air flow. As a result, the pilot flame may be blown off and the mixed gas may not be burned.

To solve the above problem, the present inventor tried to adjust the burner so that a timing for turning on the solenoid on-off valve 56 for gas became slightly faster than a timing for turning on the solenoid on-off valve 55 for air. With this adjustment, it was found out that quenching of the pilot flame could be suppressed all most completely, but that a large flame is generated at the moment of ignition, which is extremely dangerous.

SUMMARY OF THE INVENTION

Accordingly, it is a first object of the present invention to provide a metal-brazing pulse burner which is free from the above defects, and the pilot flame is not blown off and quenched during a pulse combustion, and a stable pulse combustion can always be conducted.

It is a second object of the invention to provide a metal-brazing pulse burner in which a desired pulse combustion can be conducted even if a gas pressure in a gas supply source is low.

Further, it is a third object of the invention to provide a metal-brazing pulse burner in which a temperature for brazing a metal can easily be controlled.

A metal-brazing pulse burner according to the present invention comprises a combustion air supply pipe which connects an air pump and a gas/air mixing pipe and which is provided at its intermediate portion with a solenoid valve opened and closed by a pulse signal; a pilot air supply pipe which is branched from the combustion air supply pipe upstream of the solenoid valve and is returned into the combustion air supply pipe downstream from the solenoid valve and which is provided at its intermediate portion with a flow rate adjusting valve; a combustion gas supply pipe which is provided at its intermediate portion with another solenoid valve opened and closed by a pulse signal and which connects a gas supply source and gas/air mixing pipe; a pilot gas supply pipe which is provided at its intermediate portion with a flow rate adjusting valve and which is branched from the gas supply pipe upstream of the solenoid valve and returned into the gas supply pipe downstream from the solenoid valve; a mixed gas supply pipe which connects the gas/air mixing pipe and a gas combustion portion with each other, the gas/air mixing pipe being comprised of a pipe member having a diameter larger than those of the combustion air supply pipe and the mixed gas supply pipe; and an air injection nozzle which is connected to the combustion air supply pipe to project therefrom along a central line of the pipe member, the nozzle having an injection opening at its tip end which opening faces an opening of the combustion gas supply pipe opened at a sidewall of the pipe member so that a gas in the combustion gas supply pipe is drawn and supplied by air flow injected from the air injection nozzle.

As described above, the metal-brazing pulse burner of the invention comprises a combustion air supply pipe which connects an air pump and a gas/air mixing pipe and which is provided at its intermediate portion with a solenoid valve opened and closed by a pulse signal; and a pilot air supply pipe which is branched from the combustion air supply pipe upstream of the solenoid valve and is returned into the combustion air supply pipe downstream from the solenoid valve and which is provided at its intermediate portion with a flow rate adjusting valve. Therefore, it is possible to always supply air for a pilot flame to the burner even when the solenoid valve for the combustion air supply pipe is closed.

Further, the metal-brazing pulse burner of the invention also comprises a combustion gas supply pipe which is provided at its intermediate portion with another solenoid valve opened and closed by a pulse signal and which connects a gas supply source and the gas/air mixing pipe; and a pilot gas supply pipe which is provided at its intermediate portion with a flow rate adjusting valve and which is branched from the gas supply pipe upstream of the solenoid valve and returned into the gas supply pipe downstream from the solenoid valve. Therefore, it is possible to always supply gas for a pilot flame to the burner even when the solenoid valve for the combustion gas supply pipe is closed.

Furthermore, the gas/air mixing pipe is comprised of a pipe member having a diameter larger than those of the combustion air supply pipe and the mixed gas supply pipe; and the metal-brazing pulse burner further comprises an air injection nozzle which is connected to the combustion air supply pipe to project therefrom along a central line of the pipe member, the nozzle having an injection opening at its tip end which opening faces an opening of the combustion gas supply pipe opened at a sidewall of the pipe member. Therefore, a vacuum pressure is generated in the gas/air mixing pipe due to air injected from the nozzle, a gas in the combustion gas supply pipe which is opened at the sidewall of the pipe member is drawn and is mixed with air in the gas/air mixing pipe, and is then supplied to the mixed gas supply pipe.

According to the above described arrangement, since the gas is drawn by the air stream due to the gas/air mixing pipe 3, the flow rates of air and gas become same. And as a result, the pilot flame is not blown off, and the mixed gas can be burned immediately.

It should be noted that if air at pressure of 3 kg/cm$^2$ is supplied, a vacuum pressure generated in the gas/air mixing pipe is −60 to −300 mm/Hg (which is varied depending upon the size, shape and the like of the gas-/air mixing pipe). And even if the gas pressure in the gas supply pipe is 0 (zero), it is possible to draw a gas. Therefore, a bomb normally having a gas pressure of 0.027 kg/cm$^2$ is used as a gas source, even if residue of gas in the bomb is reduced and thus the gas pressure is decreased, it is possible to supply a constant amount of gas irrespective of such decrease of gas pressure.

The above and other objects, features and advantages of the invention will become apparent from the following description of the preferred embodiment taken in conjunction with the accompanying drawings.

DESCRIPTION OF THE PREFERRED EMBODIMENT

Figure 1:
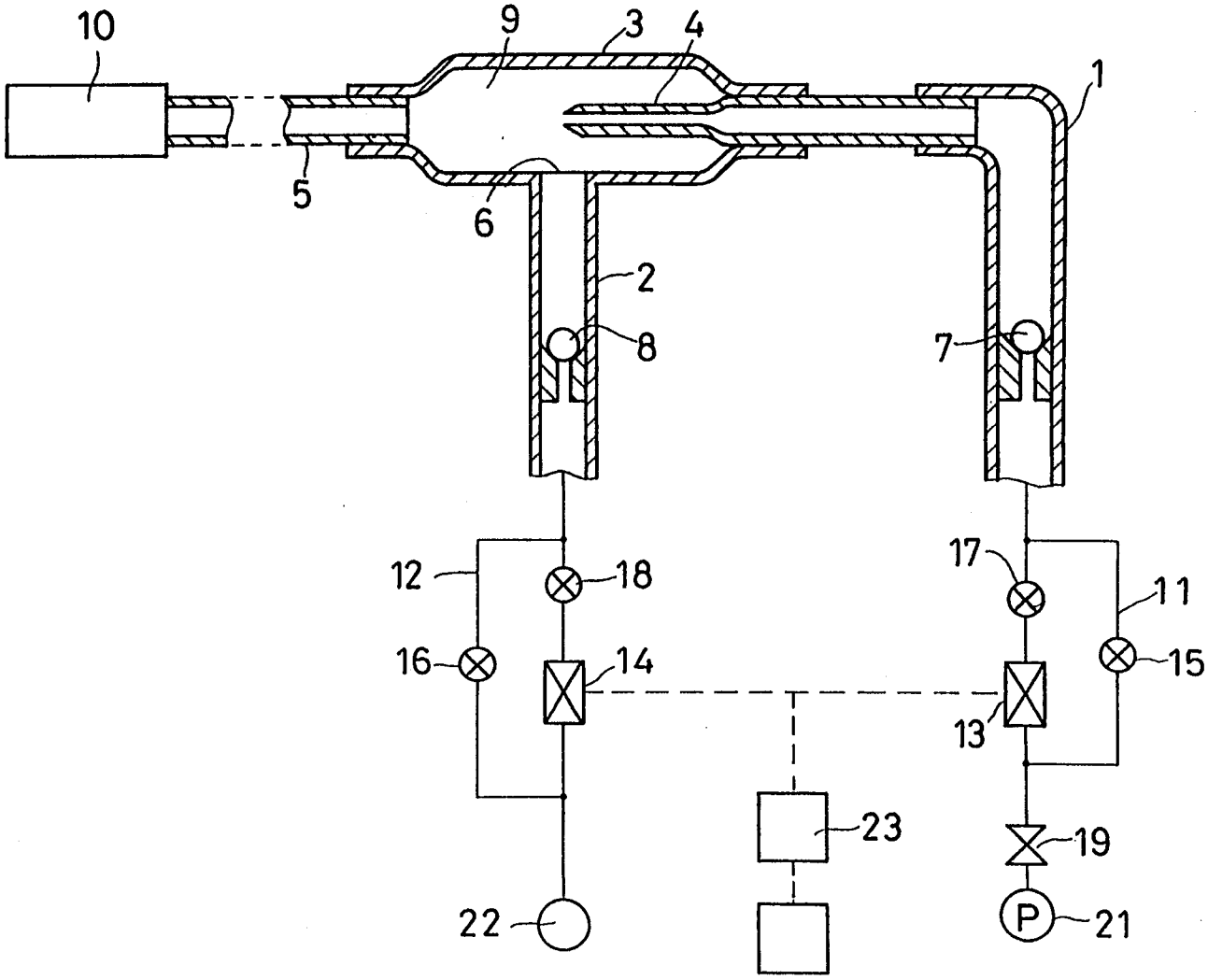
FIG. 1 is a partial side elevational view of a metal-brazing pulse burner according to an embodiment of the present invention.
Figure 2:
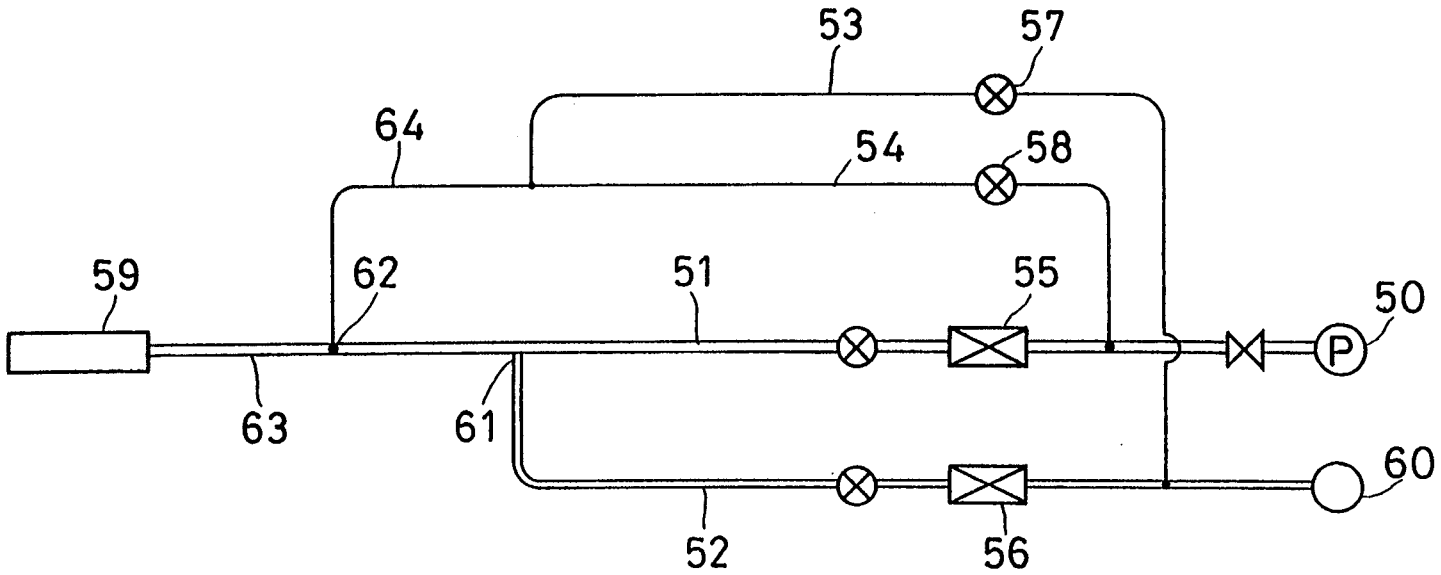
FIG. 2 is a side view of a conventional pulse burner.

FIG. 1 shows a metal-brazing pulse burner according to an embodiment of the present invention. The pulse burner includes a combustion air supply pipe 1 which connects an air pump 21 and a gas/air mixing pipe 3 and which is provided at its intermediate portion with a solenoid valve 13 opened and closed by a pulse signal; a combustion gas supply pipe 2 which is provided at its intermediate portion with another solenoid valve 14 opened and closed by a pulse signal and which connects a gas supply source 22 and the gas/air mixing pipe 3; a gas/air mixing pipe 3 being comprised of a pipe member having a diameter larger than those of the combustion air supply pipe 1 and the mixed gas supply pipe 5; and an air injection nozzle 4 which is connected to the combustion air supply pipe 1 to project therefrom along a central line of the pipe member, the nozzle 4 having an injection opening at its tip end which is located near an opening 6 of the combustion gas supply pipe 2 opened at a sidewall of the pipe member.

The pulse burner further includes a gas/air mixing chamber 9; a burner head 10; a pilot air supply pipe 11 which is branched from the combustion air supply pipe 1 upstream of the solenoid valve 13 and is returned into the combustion air supply pipe 1 downstream from the solenoid valve 13 and which is provided at its intermediate portion with a flow rate adjusting valve 15; a pilot gas supply pipe 12 which is provided at its intermediate portion with a flow rate adjusting valve 16 and which is branched from the gas supply pipe 2 upstream of the solenoid valve 14 and returned into the gas supply pipe 2 downstream from the solenoid valve 14; a controller 23 for controlling the solenoid valves 13 and 14; an opening 6 which is opened at a sidewall of the gas/air mixing pipe 3; check valves 7 and 8; and a reducing valve 19.

The operation of the metal-brazing pulse burner of the present invention which is arranged in the above manner will be described hereinafter.

The air pump 21 supplies air having a pressure of 5 kg/cm$^2$. The pressure of the air is decreased to 3 kg/cm$^2$ through the reducing valve 19 and then, the air is supplied from the nozzle 4 into the gas/air mixing pipe 3 through the solenoid valve 13 of the combustion air supply pipe 1, the flow rate adjusting valve 17 and the check valve 7.

A bomb 22 as a gas supply source supplies an LPG gas having a pressure of 0.027 kg/cm$^2$. This gas is supplied from the opening 6 into the gas/air mixing pipe 3 through the solenoid valve 14 of the combustion gas supply pipe 2, the flow rate adjusting valve 18 and the check valve 8.

The gas/air mixing pipe 3 is comprised of a pipe member having a larger diameter than those of the combustion air supply pipe 1 and the mixed gas supply pipe 5. Therefore, if the combustion air is injected from the gas/air mixing pipe 3 through the air injection nozzle 4, a vacuum pressure is generated in the gas/air mixing chamber 9 due to an air stream caused by such injected air. By this vacuum pressure, gas in the combustion gas supply pipe 2 which is opened at the sidewall of the gas/air mixing pipe 3 is drawn and flowed into the gas/air mixing chamber 9. Therefore, If the amount gas flowed into the gas/air mixing chamber 9 can be determined irrespective of a flow rate, i.e., a flow amount of air, if the gas pressure is relatively low.

When the solenoid valves 13 ad 14 for the air and gas are opened, a so-called continuous combustion is carried out at the burner head 10.

If the solenoid valves 13 and 14 are turned on and off at a duty ratio of 1:1, the air and gas are intermittently supplied and thus, a so-called pulse combustion is carried out at the burner head 10.

However, when the solenoid valves are turned on from their off-states, if there is no pilot flame, the burner does not catch fire. therefore, pilot air and gas are always supplied during the pulse combustion.

For this reason, the burner is provided with the pilot air supply pipe 11 bypassing the solenoid valve 13 for the combustion air supply pipe 1, and the pilot gas supply pipe 12 bypassing the solenoid valve 14 of the combustion gas supply pipe 2. And even when the solenoid valves are turned off during the pulse combustion, a small amount of air and gas are supplied and thus, a combustion as a pilot flame is continued. Therefore, when the solenoid valves are turned on, the burner can catch fire immediately.

As a brazing gas burner, there has conventionally been used an industrial torch burner having a gas pressure of 0.3 to 0.5 kg/cm$^2$. However, according to the present invention, since gas is drawn and supplied by a vacuum pressure which is generated by an air stream flowing in the gas/air mixing pipe 3, a necessary amount of gas can be supplied even if the gas pressure in the gas supply source is low. For instance, the present invention can sufficiently be carried out with using an LPG bomb for individual use having gas pressure of about 0.027 kg/cm$^2$. Further, since the flow rate of gas is determined in accordance with a drawing or suction force by air, even if the gas pressure from the gas supply source is slightly varied, a necessary amount of gas can be supplied at a constant flow rate.

As described above, since the flow rate of gas for controlling the temperature of the gas burner is determined only by air pressure, it is easy to control the flow rates of both gas and air, which simplifies the arrangement of controlling devices and controlling electric circuit, leading to a reduction of producing cost and working expense.

What is claimed is:

1. A metal-brazing pulse burner, comprising a combustion air supply pipe which connects an air pump and a gas/air mixing pipe and which is provided at its intermediate portion with a first solenoid valve opened and closed by a pulse signal;

a pilot air supply pipe which is branched from said combustion air supply pipe upstream of said first solenoid valve and is returned into said combustion air supply pipe downstream from said first solenoid valve and which is provided at its intermediate portion with a flow rate adjusting valve;

a combustion gas supply pipe which is provided at its intermediate portion with a second solenoid valve opened and closed by a pulse signal and which connects a gas supply source and said gas/air mixing pipe;

a pilot gas supply pipe which is provided at its intermediate portion with a flow rate adjusting valve and which is branched from said gas supply pipe upstream of said second solenoid valve and returned into said gas supply pipe downstream from the second solenoid valve;

a mixed gas supply pipe connected to said gas/air mixing pipe, said gas/air mixing pipe being comprised of a pipe member having a diameter larger than those of said combustion air supply pipe and said mixed gas supply pipe; and an air injection nozzle which is connected to the combustion air supply pipe to project therefrom along a central line of said pipe member, said nozzle having an injection opening at its tip end which opening is located near an opening of said combustion gas supply pipe opened at a sidewall of said pipe member so that a gas in said combustion gas supply pipe is drawn and supplied by air flow injected from said air injection nozzle.

2. A metal-brazing pulse burner according to claim 1, wherein a flow rate adjusting valve 17 is mounted in said combustion air supply pipe 1 downstream from said first solenoid valve 13 and a flow rate adjusting valve 18 is mounted in said combustion gas supply pipe 2 downstream from said second solenoid valve 14.

* * * * *